US007207859B1

(12) United States Patent
Iaconis et al.

(10) Patent No.: US 7,207,859 B1
(45) Date of Patent: Apr. 24, 2007

(54) REALISTIC ANIMATRONIC TOY

(75) Inventors: Michael J. Iaconis, Azusa, CA (US); Richard J. Maddocks, Barrington, RI (US); Jeffrey M. Ford, Warwick, RI (US)

(73) Assignee: Hasbro, Inc., Pawtucket, RI (US)

( * ) Notice: Subject to any disclaimer, the term of this patent is extended or adjusted under 35 U.S.C. 154(b) by 0 days.

(21) Appl. No.: 11/117,130

(22) Filed: Apr. 28, 2005

Related U.S. Application Data

(60) Provisional application No. 60/566,803, filed on Apr. 30, 2004.

(51) Int. Cl.
*A63H 3/20* (2006.01)
*A63H 3/40* (2006.01)
*A63H 3/48* (2006.01)

(52) U.S. Cl. ..... 446/330; 446/338; 446/342; 446/343; 446/345; 446/376; 446/391

(58) Field of Classification Search ..... 446/337, 446/338, 342, 343, 345, 347, 348, 376, 391; 40/414, 423
See application file for complete search history.

(56) References Cited

U.S. PATENT DOCUMENTS 2,273,836 A * 2/1942 Dale ..... 40/416
2,366,576 A 1/1945 Thomas
3,242,611 A 3/1966 Henry
3,247,683 A * 4/1966 Danker ..... 63/23
3,250,037 A 5/1966 Katz et al.
3,295,253 A 1/1967 Gardel et al.
3,419,994 A * 1/1969 Glass et al. ..... 446/300
3,494,068 A * 2/1970 Crosman ..... 446/338
3,700,384 A 10/1972 Gardel et al.
3,740,039 A 6/1973 Prola
3,754,351 A 8/1973 Glass et al.
4,224,759 A 9/1980 Saint-Pierre et al.
4,820,232 A 4/1989 Takahashi et al.
4,867,730 A 9/1989 Lee
4,869,703 A 9/1989 Ong S.T.
4,913,676 A 4/1990 Koguchi et al.
5,094,645 A 3/1992 Stern et al.
5,141,464 A 8/1992 Stern et al.
5,236,385 A * 8/1993 May ..... 446/300
5,326,302 A * 7/1994 Llorens ..... 446/288
5,498,193 A 3/1996 Locricchio
5,782,669 A 7/1998 Hornsby et al.
5,846,115 A 12/1998 Feng
6,017,261 A * 1/2000 Wachtel ..... 446/301
6,053,798 A 4/2000 Tang (Continued)

*Primary Examiner*—John A. Ricci
(74) *Attorney, Agent, or Firm*—Perry Hoffman

(57) ABSTRACT

An embodiment of the invention provides an animated plush doll such as a newborn dog or cat. The doll includes a plush covering over a housing comprising a head portion and a body portion. Disposed within the body portion is a drive mechanism including a motor and a plurality of gears. An electronic control circuit is linked to the drive mechanism for controlling the motor and producing pre-recorded songs among other things. One or more actuatable switches or sensors provide inputs to the electronic control circuit for effecting various movements of the toy. The head portion is movably coupled to the body portion and includes movable eye members. The drive mechanism is operative to move the eye members in a coordinated manner with the head portion so that the toy simulates the movements of a newborn animal such as awakening and falling asleep.

26 Claims, 7 Drawing Sheets

U.S. PATENT DOCUMENTS 6,350,170 B1 2/2002 Liu
6,371,826 B1 4/2002 Pestonji
6,544,094 B1 4/2003 Maddocks et al.
6,565,407 B1 * 5/2003 Woolington et al. ..... 446/175
6,776,681 B2 8/2004 Willett
6,843,703 B1 1/2005 Iaconis et al.

* cited by examiner

REALISTIC ANIMATRONIC TOY

CROSS-REFERENCE TO RELATED APPLICATION

This application claims priority pursuant to 35 USC 119(e) to U.S. Provisional Application No. 60/566,803 filed Apr. 30, 2004, which application is specifically incorporated by reference in its entirety.

FIELD OF INVENTION

The present invention relates to electro-mechanically actuated toys. More particularly, the invention relates to an animatronic toy that can replicate organic movements of animals and other creatures by coordinating movements of eyes and other body parts.

BACKGROUND OF THE INVENTION

Society has seen an evolution of technology in a wide variety of industries, including the toy industry. This evolution in technology is quite apparent in several sectors of the toy industry. For example, technological enhancements have made video games more realistic and lifelike than anyone could have imagined ten years ago. Technological enhancements have also affected other sectors of the toy industry in more subtle ways. For example, board games now come with video displays on a regular basis, baseballs can measure their own velocities when thrown, and dolls can now speak, walk, and even roller skate. Many of these product enhancements have been driven by customer demand. As technology continues to improve, customers want toys that have more capabilities or that are more realistic.

One example of customer driven evolutions in the industry is found in the toys embodied as creatures, animals, dolls and various other life forms real or imagined. Dolls, despite their simplicity, have long been among the most popular toys, especially among younger children. Dolls, however, are not immune to customer demands. As such, customers have continually demanded a more lifelike doll. Therefore, dolls have become more realistic as technologies applicable in the doll industry have evolved. As alluded to earlier, dolls now have enhanced movement and speaking capabilities that tend to make the doll seem more realistic and lifelike.

One important influence technological advancements have on the doll industry is seen in the development of dolls' eyes, which have evolved quite dramatically. Some of the more recent developments in doll eyes relate to making the eyes and/or eyelids movable such that the doll is more realistic. Dolls with movable lids are well known for facilitating enhanced interaction with the doll. The movable lid action typically provides for two eye states such that the eyes are open (i.e., the doll is awake) or closed (i.e., the doll is asleep). Often the movable lid action is dependent on the orientation of the doll such that when the doll is lying down (i.e., sleeping) the eyes are closed, whereas when the doll is in position different from the lying position, for example, standing or sitting, the eyes are open. Although such movable eyes/lids provide for enhanced realism, the doll is far from being truly realistic or interactive and leaves much to the user's imagination.

To provide a more realistic and interactive doll, a cost-technology trade-off becomes important. As is known, new technologies cannot typically be implemented to meet customer demands because of other constraints placed on the industry by customers. One of the most important constraints is cost. Therefore, even though technologies may exist to meet customer demands, those technologies cannot be applied to this industry until they have adapted in such a way as to be more cost effective. To this end, the toy industry has employed relatively inexpensive motors and linkage assemblies to provide realistic animatronic-type dolls. However, although such dolls may provide realistic movements of the head and limbs, the eyes may remain static or even employ the aforementioned orientation-based movable eye/lid mechanisms.

Recent attempts to increase the realism of dolls' eyes have focused on adding additional structure around the eye such as eyelids and eyelashes. One improved artificial eye is disclosed in co-pending U.S. patent application entitled "Method and Apparatus for Attaching Plush to an Artificial Eye", which is a continuation-in-part of U.S. patent application Ser. No. 10/300,084 for "Artificial Eye With Integrally Molded Eyelid" filed on Nov. 20, 2002 by Applicants' Assignee. The disclosed artificial eye with an integral lid is realistic and well suited for use with life-like creatures and dolls. To further accent its realism, the eye includes a plush engaging member that is operative to animate a portion of plush contiguous to the eye, which may correspond to an eyebrow, upper eyelid, or the like.

In view of the foregoing, a need exists for a drive mechanism to coordinate the animation of a doll's eyes and other body parts such that the doll provides life-like, organic movements facilitating realistic interaction with a user.

SUMMARY OF THE INVENTION

An embodiment of the invention provides an animated plush toy such as a newborn dog or cat. The toy includes a plush covering over a housing comprising a head portion and a body portion. Disposed within the body portion is a drive mechanism including a motor and a plurality of gears. An electronic control circuit is linked to the drive mechanism for controlling the motor and producing pre-recorded sounds among other things. One or more actuatable switches or sensors provide inputs to the electronic control circuit for effecting various movements of the toy. The head portion is movably coupled to the body portion and includes movable eye members. The eye members include a plush-engaging member that is operative to animate a portion of facial plush contiguous to the eye, which may correspond to an eyebrow, upper eyelid, or the like. The drive mechanism is operative to move the eye members in a coordinated manner with the head portion so that the toy simulates the movements of a newborn animal such as awakening and falling asleep.

BRIEF DESCRIPTION OF THE DRAWINGS

The present invention is further described with reference to the accompanying drawings, which show embodiments of the present invention. However, it should be noted that the invention as disclosed in the accompanying drawings is illustrated by way of example only. The various elements and combinations of elements described below and illustrated in the drawings can be arranged and organized differently to result in embodiments which are still within the spirit and scope of the present invention. In the drawings, wherein like reference numeral indicate like parts.

DETAILED DESCRIPTION OF THE EMBODIMENTS

Figure 1:
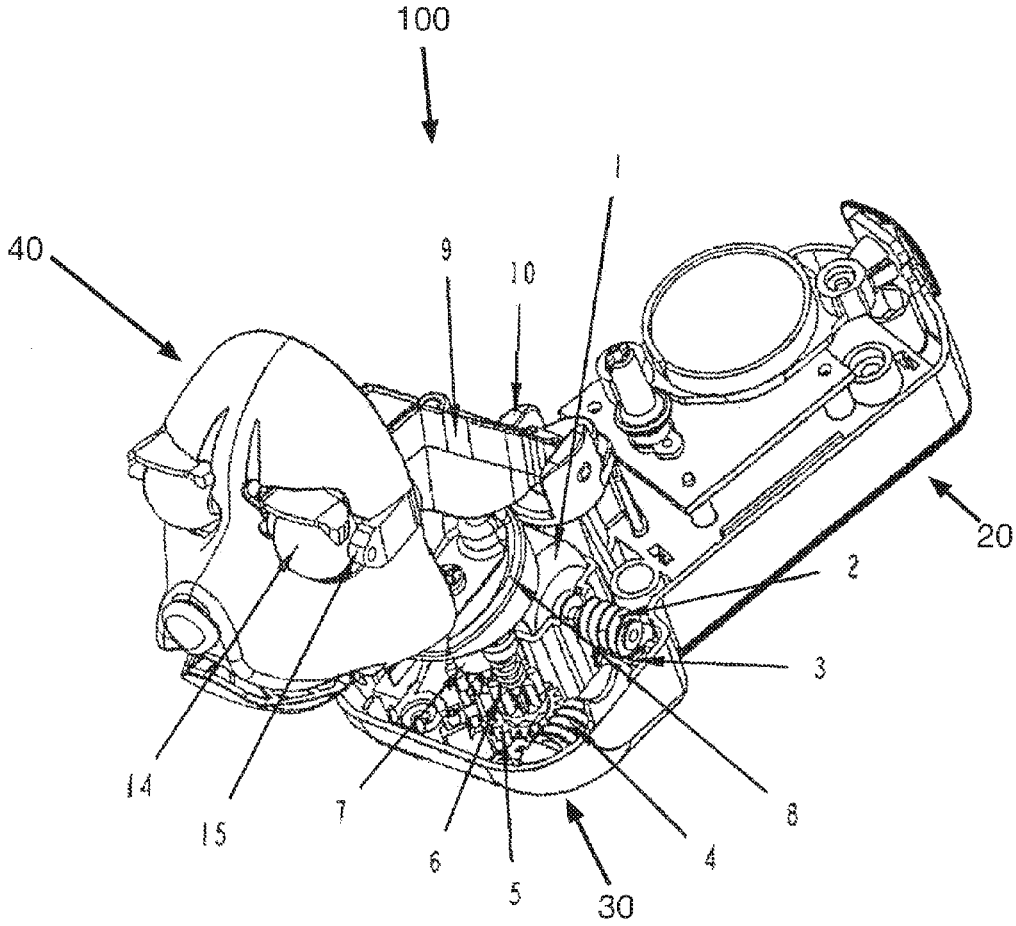
FIG. 1 is a front perspective view of one embodiment of the doll showing the general arrangement of the drive mechanism.

One embodiment of a realistic animatronic doll provides organic movement of the head and eyes to emulate a newborn animal such as a dog or cat. A preferred embodiment of the doll is available from the Assignee herein under the product name "FurReal Friends Newborn". The doll 100 includes a lengthwise elongated body portion 20 housing a mechanical drive mechanism 30, and a head portion 40 with movable eyes 14. Also disposed within the body portion 20 is an electronic control circuit (not shown) linked to the drive mechanism 30 for controlling movement of the doll 100 and for producing pre-recorded sounds among other things. The head portion 40 and eyes 14 are controlled and coordinated in response to inputs detected by various sensors, switches or the like provided for the doll 100 and linked to the control circuit. In response to detected conditions, the sensors signal the control circuitry to generate the desired coordinated movements of the doll's body parts, particularly the head 40 and eyes 14. It is preferred that the doll utilize a single, low power reversible electric motor 1 that is able to power the doll's parts for their life-like movements while providing for acceptable battery life. Further, the control circuit includes sound generating circuitry to make the doll 100 broadcast or emanate sounds in conjunction with the movement of the body parts so as enhance the ability of the doll 100 to provide seemingly organic interaction with the user in that the doll 100 can have different physical and emotional states as associated with different coordinated positions of the body parts and sounds generated by the control circuit.

Figure 2:
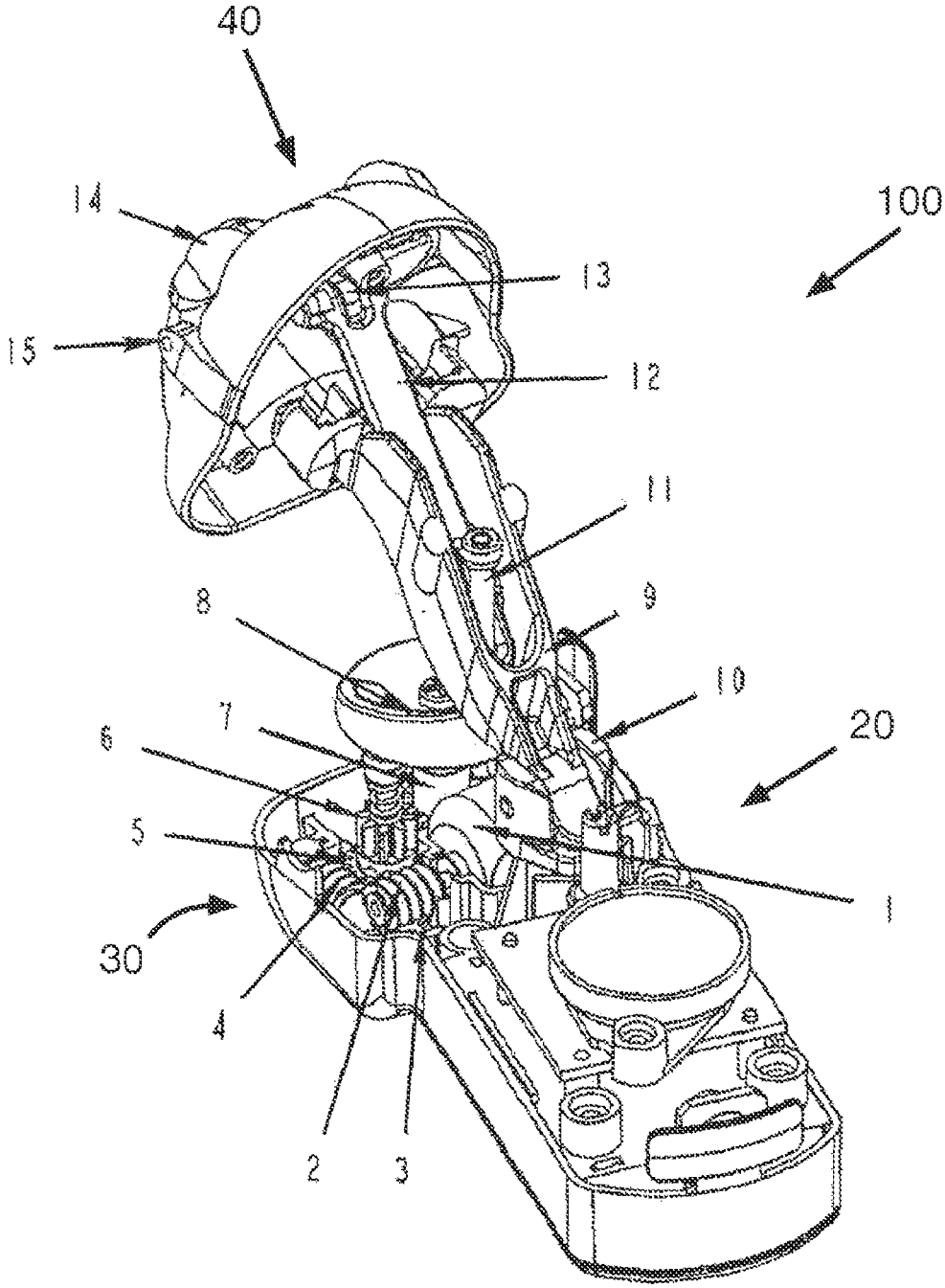
FIG. 2 is a rear perspective view of the embodiment of FIG. 1 showing eye and head actuators.

Referring now to FIGS. 1 and 2 the drive mechanism 30 is described. As shown in FIG. 1, the drive mechanism 30 includes an electric motor 1 such as a common toy-grade DC motor capable of operating at approximately 6000 rpm. The motor 1 is powered by a power source such as one or more disposable or rechargeable batteries, which is disposed within the body portion 20 such as in a battery chamber with a removably detachable battery door. A worm gear 2 is affixed to the shaft of the motor 1. The worm gear 2 and motor 1 are oriented generally transverse to the lengthwise axis of the body portion 20. As best illustrated in FIG. 1, the spur gear 3 is disposed below the worm gear 2 and is oriented such that the spur gear's axis is transverse to the worm gear's axis. The spur gear 3 is affixed to a shaft at its posterior end. The shaft projects in an anterior manner (i.e., forward or toward the doll's head portion 40) to couple with and drive a second worm gear 4. The second worm gear 4 drives a second spur gear 5 that is affixed on the bottom end of a vertical oriented shaft proximate the worm gear 4. A third spur gear 6 is mounted to the vertical oriented shaft and above the second spur gear 5 to turn in coordination with the second spur gear 5. As shown in FIGS. 1 and 2, the outer diameter of the third spur gear 6 is smaller than the outer diameter of the second spur gear 5. Additionally, a spring loaded clutching mechanism is coupled to the upper end of the vertical shaft (i.e., above the third spur gear 6). The clutching mechanism is operative to protect the motor 1 from a stall condition such as if a user holds the doll 100 tightly and inhibits normal movement of the head portion 40.

The third spur gear 6 drives a fourth spur gear 7 on a second vertical shaft proximate the first vertical shaft. The second vertical shaft is substantially centered along the anterior width of the body portion 20 such that it is approximately coincident with the body portion's lengthwise central axis. As shown in FIG. 2, a cylinder member projects upward from the upper surface of the fourth spur gear 7 and couples to a cam member 8. As shown in FIG. 1, the cam member 8 is generally circular and includes an upper cam surface about its circumference. As best illustrated in FIG. 2, the cam surface of the cam member 8 includes a raised portion and a depressed portion that are generally diametrically opposed to each other. Additionally, the cam surface provides smooth curved or angled transition portions between the raised and depressed portions such that when the cam member 8 is viewed in elevation, it is generally wedge shaped. Thus, when the motor 1 operates to drive the gear arrangement comprising gears 2, 3, 4, 5, 6, and 7, the cam member 8 rotates such that the cam surface provides a vertical undulate motion.

Figure 3A:
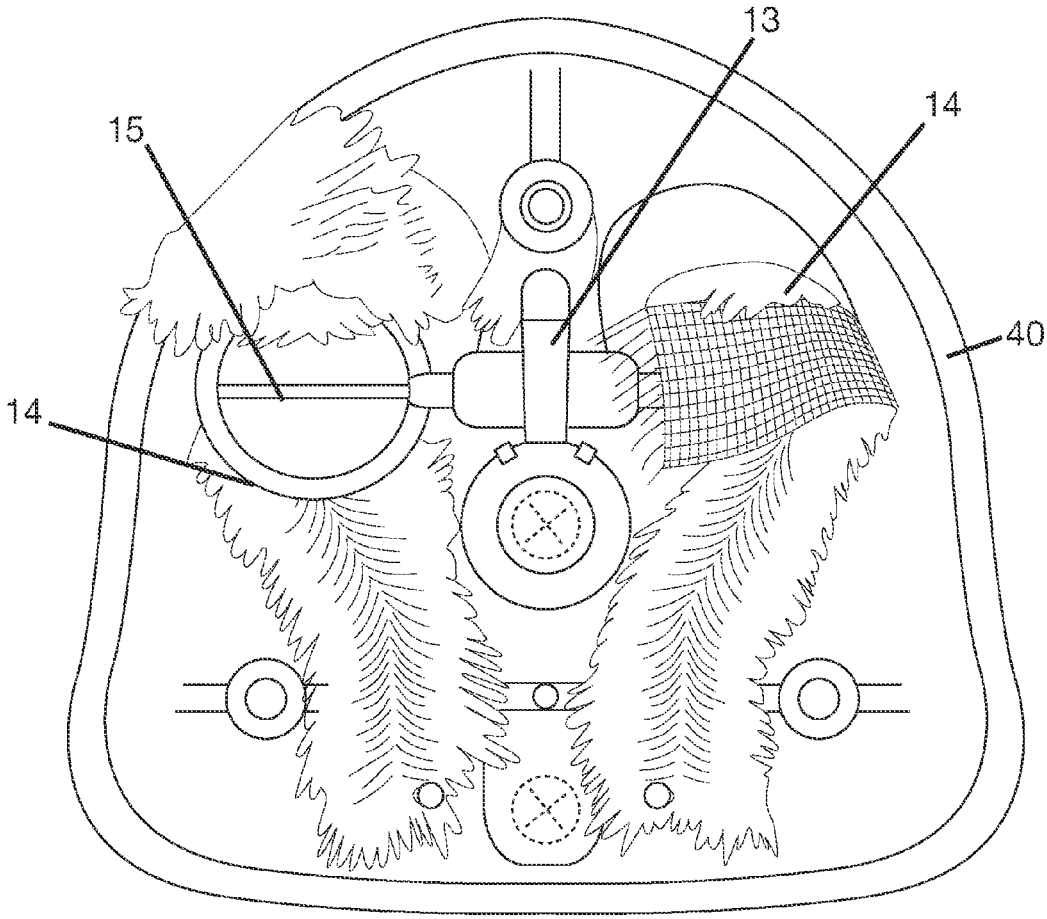
FIG. 3A is a view of the inside of the head portion showing the eyes and attachment of plush thereto.

Referring now to FIG. 1, the head portion 40 is described. As shown, the head portion 40 includes a housing sized and shaped to resemble the face of an animal having eyes 14, a mouth, and a nose. Although the head portion 40 is illustrated to resemble an animal face, other sizes and shapes are contemplated. As shown, the eyes 14 are generally spherical or bowl-shaped members each having an upper plush engagement member. The eyes 14 are preferably made out of plastic, resin, or the like. The eyes may include various items, such as a pupil and an iris, which can be painted or positioned within or behind the spherical or bowl-shaped member to provide a realistic appearance. Furthermore, each eye may include a three-dimensional border member partially surrounding and unitary with the spherical bowl-shaped member. The border member may represent an eyelid, tear duct, ocular muscles, or the like to make the eye appear more realistic. As shown in FIG. 3A, each eye 14 includes a generally plush-engaging member integral with the eye. The plush-engaging member includes a radially curved portion substantially corresponding to the curvature of the spherical bowl-shaped member that contacts a portion of the plush covering proximate the eye 14. Further, the eyes 14 are interconnected on eye shaft 15 to move together in a coordinated manner such that the doll may blink and/or open and close the eyes 14 simultaneously. To this end, a crank or lever 13 is provided on the shaft 15 to pivot or rotate the eyes 14. The lever 13 is actuated via the aforementioned cam member 8 by way of a linkage system discussed hereafter in further detail.

Referring now back to FIG. 2, the linkage system coupling the body portion 20 and head portion 40 is described. As shown, the doll 100 includes a neck member 9 that angles generally anterior and upward relative to the body portion 20. The neck member 9 posterior end is coupled to the body portion 20 by neck pivot member 10 (see also FIGS. 5A and 5B), whereas the anterior end is fixedly connected to the head portion 40 by fasteners. The neck pivot member 10 is somewhat cylindrical with a central u-shaped cutout. The posterior end of neck member 9 is inserted into the central u-shaped cutout and affixed therein by a fastener such as a pivot pin or the like such that the anterior end of the neck member 9 is free to move up and down by pivoting about the fastener. To this end and as best illustrated in FIGS. 1 and 2, the bottom surface of the neck member 9 proximate the neck pivot member 10 contacts the cam surface of cam member 8 and acts as a cam follower such that the cam surface levers the neck member 9 up and down as the motor 1 operates.

Furthermore, the pivot member 10 is rotatably coupled to the body portion 20 such that the neck member 9 may move or pivot horizontally side to side. As shown in FIG. 2, vertical rod 11 projects upward through the neck member 9. The lower end of the rod 11 is connected to the cam member 8 proximate the raised portion of the cam surface (FIG. 1). Now, along with the foregoing vertical movement of the neck member 9 effected by the cam member 8, the cam member 8 via rod 11 imparts a horizontal motion to the neck member 9. The combined simultaneous vertical and horizontal movements of the neck member 9 results in a motion of the head portion 40 that emulates the somewhat wobbly raising and lowering of a newborn animal's head.

Figure 3B:
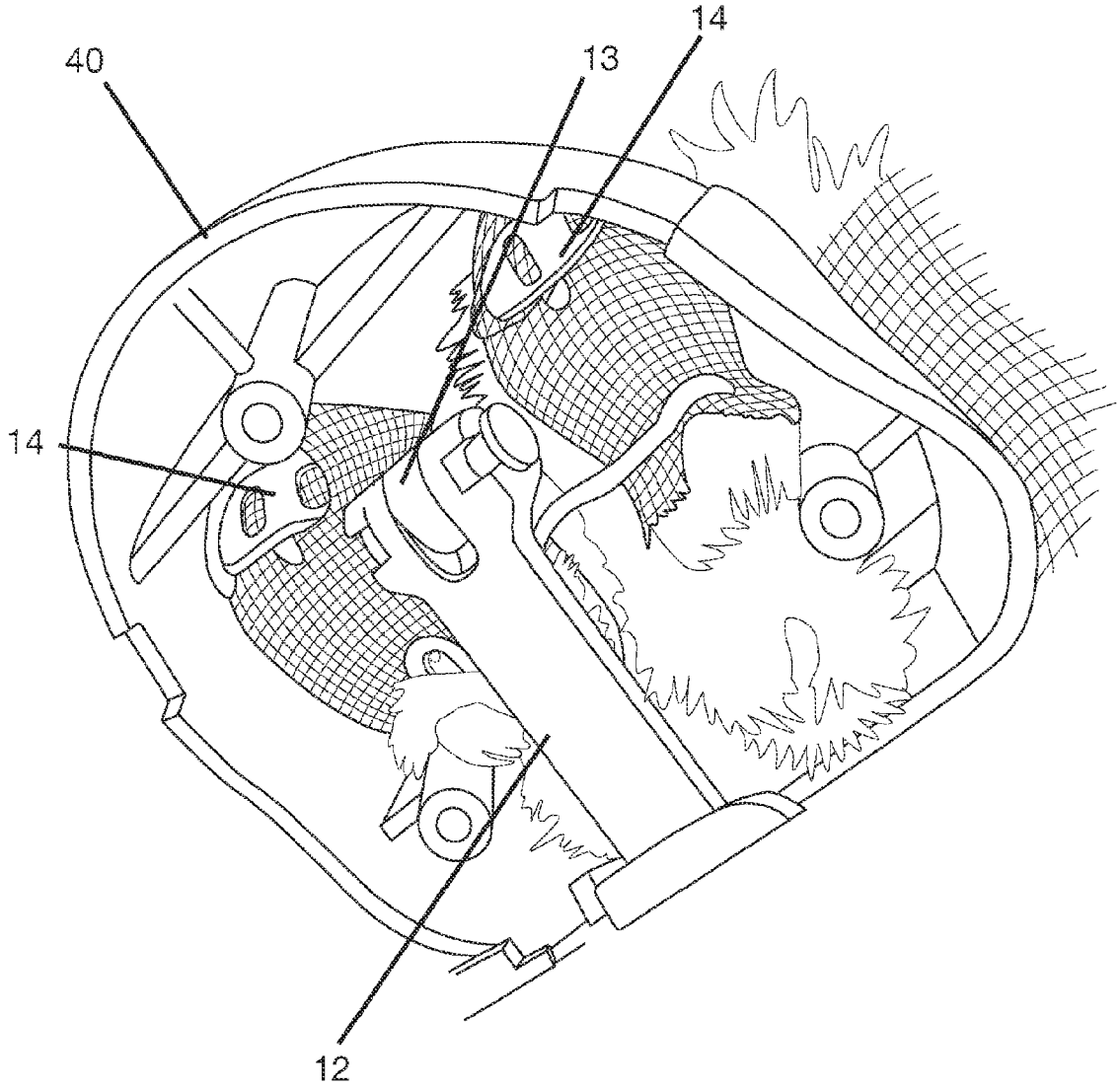
FIG. 3B is a view of the inside of the head portion showing the coupling of the eye actuator to the eyes.
Figure 4:
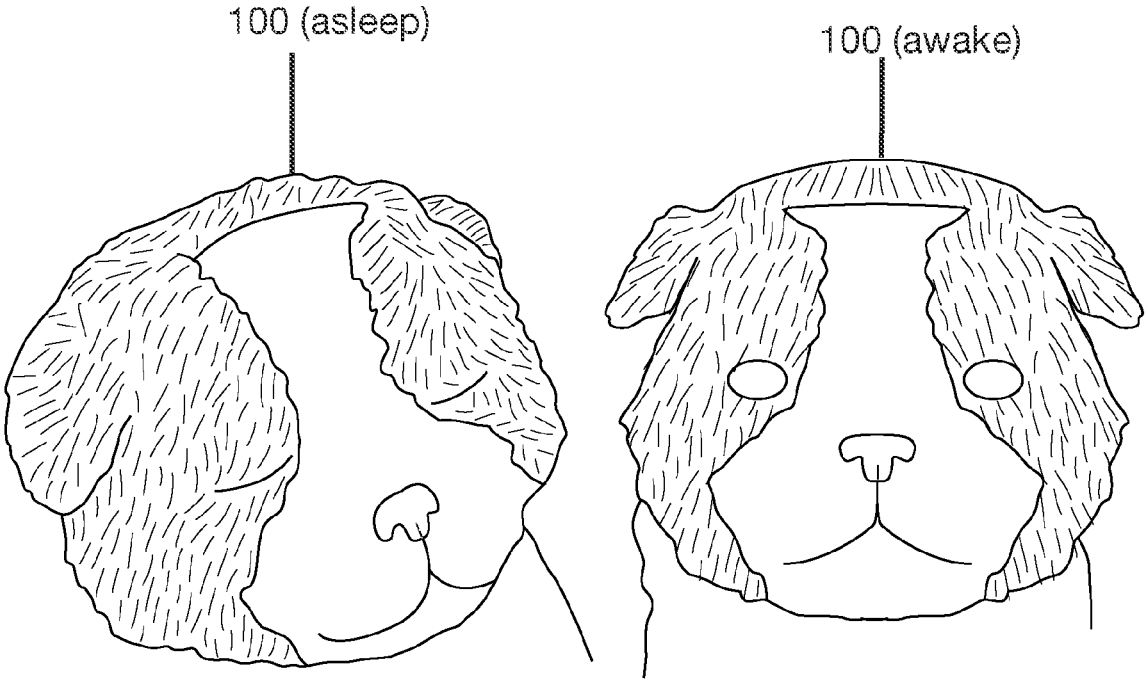
FIG. 4 shows a front view of two dolls in accordance with the embodiment of the foregoing figures illustrating the movement of the eye and head.
Figure 5A:
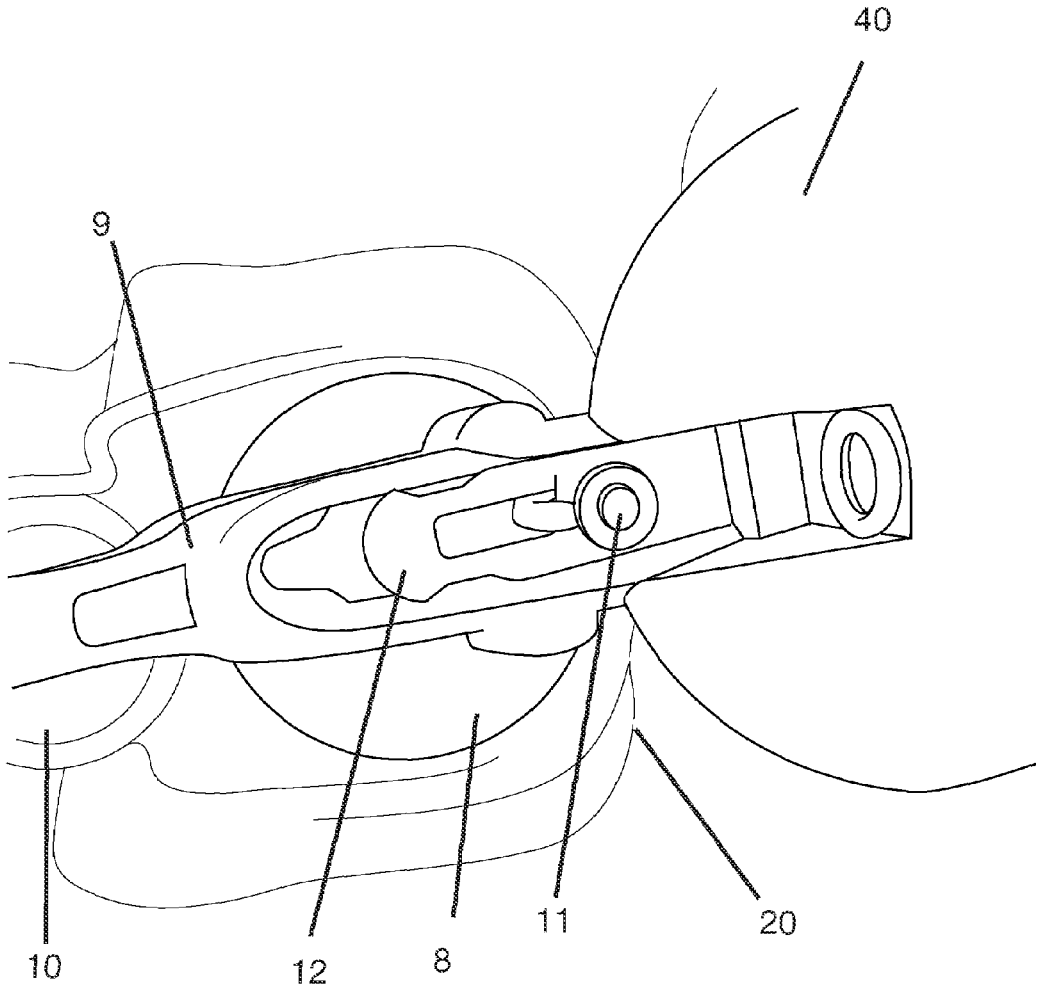
FIGS. 5A and 5B show top views of the eye actuator illustrating the combination movement of the eyes and head portion.
Figure 5B:
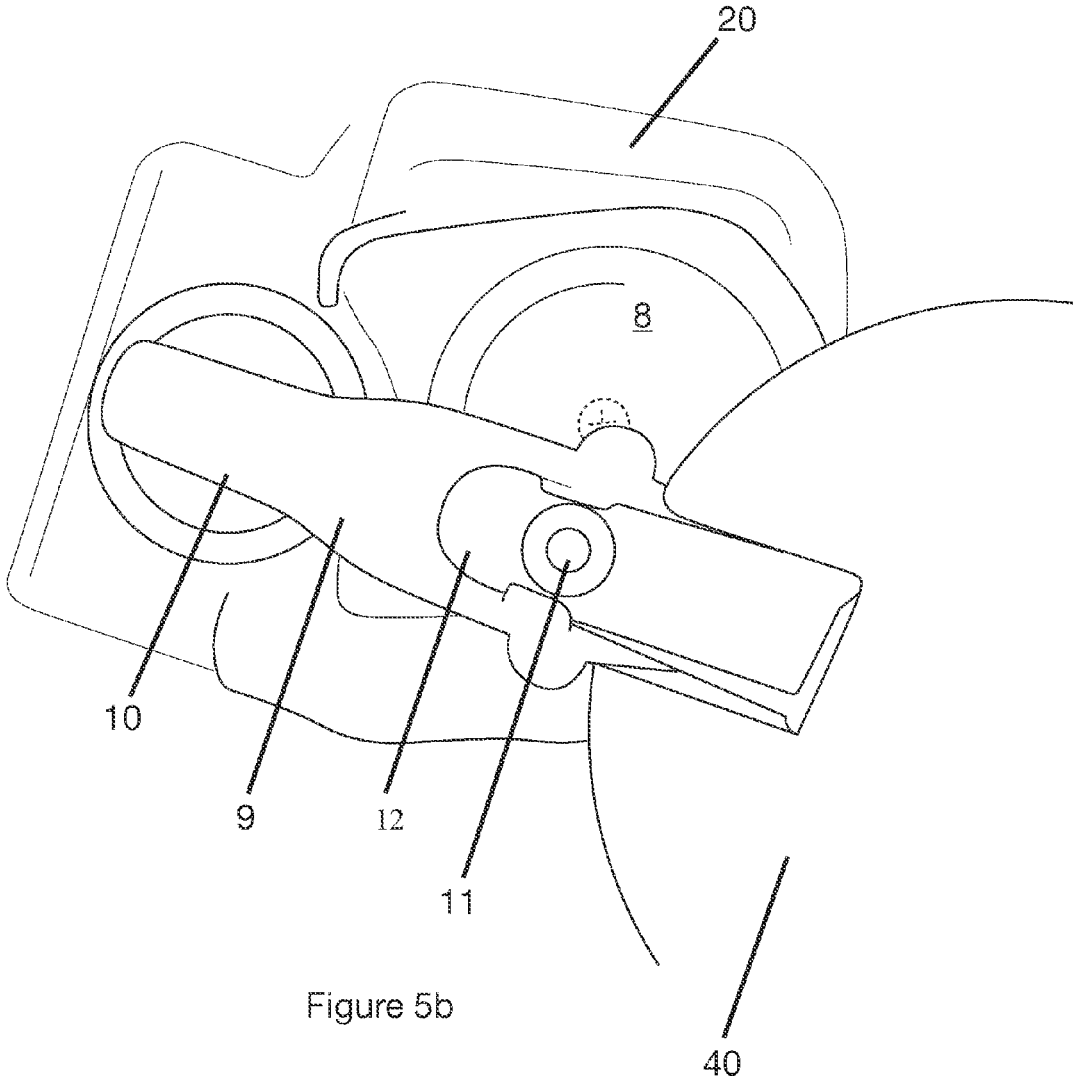

Additionally, the cam member 8 rotation provides for a coordinated movement of the eyes 14 in conjunction with the raising and lowering of the head portion 40. As shown in FIG. 2 and FIGS. 5A and 5B, the neck member 9 includes a central and lengthwise channel. A lengthwise eye-actuating member 12 is sized and shaped to fit within the lengthwise channel of the neck member 9 and translate axially (i.e., forward and backward along the length of the neck member 9) therein. As best illustrated in FIG. 5A, the posterior end of the actuating member 12 includes an oval, elliptical or otherwise elongated slot through which the rod 11 projects. As shown in FIG. 3B, the anterior end of the actuating member 12 has a generally forked shape and is coupled to the eye lever 13 by a fastener such as a pin. The actuating member 12 pivotally drives the lever 13 up and down to pivot the eyes 14 between an open position and a closed position (FIG. 4). To effect the closed eye position, the eyes 14 are rotated generally downward when the rod 11 rotates to an anterior position where it contacts the anterior portion of the elongated slot and drives the actuating member 12 forward in the neck member 9 (FIG. 5A). As the actuating member 12 translates forward in the neck member 9, the forked end of the actuating member 12 drives the free end of the lever 13 upward to rotate the eyes 14 closed. Further, as shown in FIG. 5A, when the actuating member 12 is maximally forward, the cam member 8 is oriented such that the raised portion of the cam surface is anterior (i.e., the depressed portion is proximate the neck pivot 10) and the neck member 9 and head portion 40 are not elevated. To effect the open eye position, the eyes 14 are rotated generally upward when the rod 11 rotates to a posterior position where it contacts the posterior portion of the elongated slot and drives the actuating member 12 rearward in the neck member 9 (FIG. 5B). As the actuating member 12 translates rearward in the neck member 9, the forked end of the actuating member 12 drives the free end of the lever 13 downward to rotate the eyes open and pull the plush upward and inward. As the cam member 8 rotates, the rod 11 travels in a circle and forces the actuating member 12 to slide forward and backward in the channel thereby acting on the lever 13 to pivot the eyes 14 as described. The elongated slot in the actuating member 12 causes a delay in the opening and closing of the eyes 14 relative to the raising and lowering of the head respectively so as to better simulate the organic movements of a newborn animal.

Referring now to FIG. 4, the doll 100 has a static (e.g., resting or sleeping as shown by the left-side doll) state where its head and/or face and eyes are rotated downward and eyelids are closed. From this static state, the user may activate the doll 100 by pressing a button, or by triggering a sensor linked to the electronic control circuit. The sensor may provide for sound activation, light activation, or other activations known in the art. Upon activating the doll 100, the drive mechanism 30 is operable to effect rotation of the eyes 14 and movement of the head to emulate an awakening. Additionally, the control circuit may provide for enunciating pre-recorded awakening sounds by way of a speaker and audio driver circuit. To effect the animation of closing eyes and a falling asleep doll 100, the drive mechanism 30 may operate in the reverse of the foregoing by reversing operation of the motor 1 such that the eyes 14 are rotated downward and the head is lowered. As an alternative to reversing, the motor may be provided advantageously to rotate in one direction only, to complete the falling asleep/waking up cycle described by rotating the cam 8 through 360 degrees to save on electronic component costs in production.

The embodiments described above and illustrated in the figures are presented by way of example only, and are not intended as a limitation upon the concepts and principals of the present invention. As such, it will be appreciated by one having ordinary skill in the art that ordinary changes in the elements and their configuration and arrangement are possible without departing from the spirit and scope of the present invention.

What is claimed is:

1. A doll comprising:

a head;

a body;

a mechanical drive mechanism disposed at the body, the drive mechanism comprising:

a clutching mechanism operative to uncouple the head and body from each other;

a motor, and a cam member linked to the motor; and a cam follower comprising a first end pivotally coupled at the body and a second end coupled to the head, the cam follower providing a neck member therebetween for contacting the cam member to move the head generally up and down in response to movement of the cam member, said cam member further comprising an upwardly extending member in communication with the neck member.

2. A doll as recited in claim 1 wherein the cam member is linked to the motor by a gear linkage with the clutching mechanism to prevent stalling of the motor when movement of the head is inhibited.

3. A doll as recited in claim 2 wherein the clutching mechanism is a spring-loaded clutch.

4. A doll as recited in claim 1 wherein the upwardly extending member further comprises a vertical rod that projects upwardly through the neck member.

5. A doll as recited in claim 1 wherein the cam member is circular in shape and rotates about a generally vertical central axis.

6. A doll comprising:

a head;

a body;

a mechanical drive mechanism disposed at the body, the drive mechanism comprising:

a motor, and a cam member linked to the motor; and a cam follower comprising a first end pivotally coupled at the body and a second end coupled to the head, the cam follower providing a neck member therebetween for contacting the cam member to move the head generally up and down in response to movement of the cam member, wherein the head comprises movable eyes, and the neck member comprises an eye-actuating member including a free first end coupled with the cam member and a second end operative to pivot the movable eyes between open and closed positions relative to the up and down movement of the head.

7. A doll as recited in claim 6 wherein the cam member further comprises a vertical rod that projects upwardly through the neck member.

8. A doll as recited in claim 6 wherein the cam member is circular in shape and rotates about a generally vertical central axis.

9. A doll comprising:

a head;

a body;

a mechanical drive mechanism disposed at the body, the drive mechanism comprising:

a motor, and a cam member linked to the motor; and a cam follower comprising a first end pivotally coupled at the body and a second end coupled to the head, the cam follower providing a neck member therebetween for contacting the cam member to move the head generally up and down in response to movement of the cam member, wherein the cam member comprises a vertical rod that projects upwardly through the neck member with the head comprising movable eyes and the neck member comprising an eye-actuating member including a free first end coupled with the vertical rod and a second end operative to pivot the movable eyes between open and closed positions.

10. A doll as recited in claim 9 wherein the first end of the eye-actuating member further comprises a slot for cooperating with the vertical rod such that the movable eyes are moved to the open position when the head is moved upward, and moved to the closed position when the head is moved downward.

11. A doll as recited in claim 10 wherein the slot is elongated to provide a dwell time in the moving of the eyes relative to the raising and lowering of the head portion to effect the respective animations of awakening and falling asleep of a newborn animal.

12. A doll as recited in claim 9 wherein the cam member is circular in shape and rotates about a generally vertical central axis.

13. A doll comprising:

a head;

a body;

a mechanical drive mechanism disposed at the body, the drive mechanism comprising:

a motor, and a cam member linked to the motor; and a cam follower comprising a first end pivotally coupled at the body and a second end coupled to the head, the cam follower providing a neck member therebetween for contacting the cam member to move the head generally up and down in response to movement of the cam member, wherein the cam member comprises a vertical rod that projects upwardly through the neck member, the vertical rod cooperating with the neck member to move the head generally side to side in response to the movement of the cam member.

14. A doll as recited in claim 13 wherein the combination of the generally side to side movement and the generally up and down movement of the head emulates the somewhat wobbly head raising and lowering of a newborn animal.

15. A doll as recited in claim 14 wherein the head further comprises movable eyes, and the neck member further comprises an eye-actuating member including a free first end coupled with the vertical rod and a second end operative to pivot the movable eyes between open and closed positions such that the open eye position corresponds substantially with the raised head position and the closed eye position corresponds substantially with the lowered head position.

16. A doll as recited in claim 13 wherein the cam member is circular in shape and rotates about a generally vertical central axis.

17. A doll comprising:

a head;

a body;

a mechanical drive mechanism disposed at the body, the drive mechanism comprising:

a motor, and a cam member linked to the motor, wherein the cam member is circular in shape and rotates about a generally vertical central axis; and a cam follower comprising a first end pivotally coupled at the body and a second end coupled to the head, the cam follower providing a neck member therebetween for contacting the cam member to move the head generally up and down in response to movement of the cam member, said cam member further comprising an upwardly extending member in communication with the neck member.

18. A doll as recited in claim 17 wherein the cam member further comprises a rod generally parallel with the vertical central axis, the rod projecting upwardly through the neck member for imparting a horizontal motion to the head.

19. A doll as recited in claim 18 wherein the cam member further comprises a cam surface including surface variations parallel to the vertical central axis.

20. A doll as recited in claim 19 wherein the cam surface comprises:

a depressed portion;

a raised portion generally opposed to the depressed portion; and transition portions bridging the raised and depressed portions such that the cam surface imparts a vertical undulate motion to the neck member as the cam member rotates about the generally vertical central axis.

21. A doll as recited in claim 20 wherein the vertical rod is proximate the raised portion.

22. A doll as recited in claim 21 wherein the combination of the horizontal motion imparted to the neck member by the vertical rod and the vertical undulate motion imparted to the neck member by the cam surface effects a motion to the head that emulates the somewhat wobbly head raising and lowering of a newborn animal.

23. A doll as recited in claim 22 wherein the head further comprises movable eyes, and the neck member further comprises an eye-actuating member including a free first end coupled with the vertical rod and a second end operative to pivot the movable eyes between open and closed positions.

24. A doll as recited in claim 23 wherein the first end of the eye-actuating member further comprises a slot for cooperating with the vertical rod such that the movable eyes are moved to the open position when the head is moved upward, and moved to the closed position when the head is moved downward.

25. A doll as recited in claim 24 wherein the slot is elongated along the eye-actuating member to provide a dwell time in the moving of the eyes relative to the raising and lowering of the head portion to effect the respective animations of awakening and falling asleep of a newborn animal.

26. A doll as recited in claim 17 wherein the upwardly extending member further comprises a vertical rod that projects upwardly through the neck member.

* * * * *